US006321713B1

(12) United States Patent
Mallen

(10) Patent No.: US 6,321,713 B1
(45) Date of Patent: Nov. 27, 2001

(54) HOT WALL COMBUSTION INSERT FOR A ROTARY VANE PUMPING MACHINE

(75) Inventor: Brian D. Mallen, Charlottesville, VA (US)

(73) Assignee: Mallen Research Corporation, Charlottesville, VA (US)

( * ) Notice: Subject to any disclaimer, the term of this patent is extended or adjusted under 35 U.S.C. 154(b) by 0 days.

(21) Appl. No.: 09/631,882

(22) Filed: Aug. 2, 2000

(51) Int. Cl.[7] ..... F02B 53/00
(52) U.S. Cl. ..... 123/243; 418/152
(58) Field of Search ..... 123/243, 306; 418/152, 218, 219

(56) References Cited

U.S. PATENT DOCUMENTS 3,961,483 * 6/1976 Wiley ..... 418/219
4,870,827 * 10/1989 McFarlin et al. ..... 418/152
5,100,308 * 3/1992 Gevelhoff et al. ..... 418/152
5,979,395 * 11/1999 Mallen et al. ..... 123/234

FOREIGN PATENT DOCUMENTS

402033414 * 2/1990 (JP) .
402227592 * 9/1990 (JP) ..... 418/152

* cited by examiner

*Primary Examiner*—Thomas Denion
*Assistant Examiner*—Thai Ba Trieu
(74) *Attorney, Agent, or Firm*—Jones Volentine, P.L.L.

(57) ABSTRACT

A rotary vane combustion engine is provided that uses a hot wall combustion insert to provide the heat for combusting a fuel-air charge. The rotary vane combustion engine includes a rotor having a plurality of vanes, a stator enclosing the rotor to form a plurality of vane cells between the plurality of vanes, one or more intake ports for providing intake gas to the vane cells, a fuel source for mixing fuel with the intake gas to form a fuel-air charge having a fuel-to-air equivalence ratio, a hot wall combustion insert with an exposed surface provided on the stator for igniting the fuel-air charge during a combustion cycle and producing an exhaust gas, and one or more exhaust ports for removing the exhaust gas from one of the vane cells. The hot wall combustion insert provides the heat to combust the fuel-air charge, and operates on the gas over a wide area, rather than only at a point or a given line of contact. Once the hot wall combustion insert surface reaches the ignition temperature, it can use the heat from the combustion in a given vane cell to maintain its temperature for combustion in the next vane cell.

19 Claims, 6 Drawing Sheets

HOT WALL COMBUSTION INSERT FOR A ROTARY VANE PUMPING MACHINE

BACKGROUND OF THE INVENTION

1. Field of the Invention

The present invention generally relates to rotary vane pumping machines. More particularly, the present invention relates to a hot wall combustion insert for improving combustion parameters in a rotary vane internal combustion engine.

2. Description of Related Art

This class of rotary vane combustion engines includes designs having a rotor with slots with a radial component of alignment with respect to the rotor's axis of rotation, vanes which reciprocate within these slots, and a chamber contour within which the vane tips trace their path as they rotate and reciprocate within their rotor slots.

The reciprocating vanes thus extend and retract synchronously with the relative rotation of the rotor and the shape of the chamber surface in such a way as to create cascading cells of compression and/or expansion, thereby providing the essential components of a combustion engine. For ease of discussion, a rotary vane engine will be discussed in detail.

A prior combustion design was described in pending U.S. patent application Ser. No. 08/398,443, to Mallen, filed Mar. 3, 1995, entitled "SLIDING VANE ENGINE," now issued as U.S. Pat. No. 5,524,587 on Jun. 11, 1996 (the '587 patent). The '587 patent generally describes the operation of a sliding vane engine. The operation of a vane engine using this prior combustion design will now be described.

FIG. 1 is a side cross sectional view of a conventional rotary-vane combustion engine. FIG. 2 is an unrolled view of the cross-sectional view of FIG. 1.

As shown in FIG. 1, the rotary engine assembly includes a rotor 10, a chamber ring assembly 20, and left and right linear translation ring assembly plates (not shown in full).

The rotor 10 includes a rotor shaft 11, and the rotor 10 rotates about the central axis of the rotor shaft 11 in a counterclockwise direction as shown by arrow "R" in FIG. 1. The rotor 10 has a rotational axis, at the axis of the rotor shaft 11, that is fixed relative to a stator cavity 21 contained in the chamber ring assembly 20.

The rotor 10 houses a plurality of vanes 12 in vane slots 13, and each pair of adjacent vanes 12 defines a vane cell 14. The contoured stator cavity 21 forms the roughly circular shape of the chamber outer surface.

The linear translation ring assembly plates are disposed at each axial end of the chamber ring assembly 20, and each includes a linear translation ring 31. Each linear translation ring 31 itself spins freely around a fixed hub 32 located in the linear translation ring assembly plate, with the axis of the fixed hub 32 being eccentric to the axis of rotor shaft 11.

A combustion residence chamber 26 is provided in the chamber ring assembly 20. The combustion residence chamber 26 is a cavity within the chamber ring assembly 20, radially and/or axially disposed from a vane cell 14, which communicates with air or a fuel-air charge in the vane cell 14 at about peak compression in the engine assembly. The combustion residence chamber 26 creates an extended region in communication with the vane cell 14 during peak compression.

The combustion residence chamber creates a source of ignition in the vane cell 14 where the combustion residence chamber 26 meets the vane cell 14, which ignition must spread substantially throughout the entire vane cell 14. It is important that the combustion time be of a sufficient duration for proper operation of the combustion residence chamber.

One or more fuel injecting or delivery devices 27 may be used and may be placed on one or both axial ends of the chamber and/or on the outer or inner circumference to the chamber and/or in an intake manifold upstream of the intake port to the engine. Each injector 27 may be placed at any position and angle chosen to facilitate equal distribution within the cell or vortices while preventing fuel from escaping into the exhaust stream.

Fresh intake air or a fuel-air charge, "I" is provided to the vane engine through an intake port 23 formed in the linear translation ring assembly plate and/or chamber ring 20. Similarly, combusted air or fuel-air charges, i.e., an exhaust gas, "E" is removed from the vane engine through an exhaust port 25, also formed in the linear translation ring assembly plate and/or chamber ring 20.

The rotation of the rotor 10 in conjunction with the linear translation rings automatically sets the radial position of the vanes 12 at any rotor angle, producing a single contoured path as traced by the vane tips resulting in a unique stator cavity 21 shape that mimics and seals the path the vane tips trace.

The illustrated internal combustion engine employs a two-stroke cycle to maximize the power-to-weight and power-to-size ratios of the engine. The intake of the fresh air "I" and the scavenging of the exhaust gas "E" occur at the regions as shown in FIG. 1. One complete engine cycle occurs for each revolution of the rotor 10.

Fresh air can be mixed with fuel during the compression stage in alternate embodiments.

In operation, the vane engine shown in FIGS. 1 and 2 operates as follows.

The combustion charge is introduced into the vane chamber 14 through the intake "I" during an intake cycle 510. This combustion charge is preferably air or a fuel-air mix, and may have fuel added to it by the fuel injection device 27. The mixed fuel and air are then compressed in the vane chamber 14 during a compression cycle 520, as the rotor 10 continues its motion.

As the vane chamber 14 reaches the combustion residence chamber 26, a combustion cycle 530 is performed. During the combustion cycle 530, the air and fuel are combusted, causing a dramatic increase in heat and pressure. An initial combustion reaction is initiated by hot gases exiting the combustion residence chamber 26 and this jet is introduced to the vane chamber 14 during the combustion cycle 530 as a source of ignition. This combustion reaction then spreads circumferentially and radially throughout the vane chamber 14 until the air and fuel in the vane chamber have been substantially combusted. The combustion residence chamber is then automatically re-pressurized or primed with hot combusted gases for this combustion process to begin again with the subsequent vane cell. Sufficient time must be available for the combustion within the vane cell to be substantially complete and for the combustion residence chamber to be primed for the subsequent vane cell.

The combusted fuel and air are then expanded in an expansion cycle 540, and removed via an exhaust cycle 550.

FIG. 2 simply shows the operation of FIG. 1 in an 'unrolled' state, in which the circular operation of the vane engine assembly is shown in a linear manner. The progression of the cycles 510, 520, 530, 540, and 550 can be seen quite effectively through FIG. 2.

In conventional designs spark plugs and glow plugs would initiate the combustion cycle 530. These methods of initiating combustion may be described as point ignition sources. Point ignition activates combustion of the fuel-air mixture at a local site in a given vane cell 14. However, the large surface area of the chamber wall surrounding the vane cell 14, results in a large distance that must be traversed by the propagating flame front before the combustion cycle can be complete.

As a result of this limitation and the low energy of the ignition method, point ignition devices such as glow plugs and spark plugs are unable to combust the ultra-lean mixtures necessary for ultra low emissions and best fuel economy. An important reason for the difficulty in achieving such flame propagation through an ultra-lean mixture is due to Damköhler number effects. For a discussion of Damk öhler number effects on flame propagation, see "Blowout of Turbulent Diffusion Flames", J. E. Browdwell, W. J. A. Dahm, & M. G. Mungel, $20^{th}$ Symposium (International) on Combustion/The Combustion Institute, 1984, pp. 303–310.

In short, however, point ignition devices lack the energy as well as the spatial and temporal exposure to successfully combust a premixed, ultra-lean fuel-air charge employing conventional hydrocarbon fuels within a rotary vane engine.

As a result of this, the use of a combustion residence chamber 26 has been proposed and employed. As noted above, the combustion residence chamber 26 is a small cavity strategically located within the chamber ring assembly 200. An orifice in the chamber ring assembly allows for communication of fuel-air mixtures between the point of maximum compression and the combustion residence chamber 26. This orifice may extend along the entire axial breadth of the vane cell, allowing for a line of combustion initiation, rather than simply a point source.

In operation, the combustion residence chamber 26 retains combustion gasses from one combustion cycle and uses them as an ignition source for the next combustion cycle. At the beginning of a given combustion cycle, a high-energy jet of hot combusted gases from the combustion residence chamber 26 rushes into the incoming vane cell 14 to initiate combustion and stir the reactants.

The combustion residence chamber 26 is thus not a point ignition source, but is a high-energy combustion device with greater spatial and temporal span, and so overcomes many of the limitations of spark plugs and glow plugs. It induces initial combustion reactions over a much larger zone with much greater energy and mixing effects. Furthermore, the hot jet orifice sweeps across the vane cell 14, providing excellent access and mixing to the reactants.

As a result of this, the combustion residence chamber system is capable of combusting much leaner premixed mixtures than would be possible with point ignition devices such as spark plugs, thereby permitting great reductions in pollution output and improvements in operating efficiency.

However, in order to obtain adequate mixing of the reactants the jet from the combustion residence chamber must move at high velocity, causing higher heat transfer and an associated efficiency loss. And while the combustion residence chamber works across a range of operating conditions, top engine speed may be limited by the requirement to promptly refill the combustion residence chamber with high pressure gas prior to the subsequent combustion cycle 530.

If the combustion residence chamber does not refill effectively prior to the subsequent vane cell's communication with the chamber, or for any other reason suffers a "flame-out," i.e., a loss of adequate temperature and/or pressure to complete a combustion cycle, then operational problems may occur. Addressing these problems in-process may require substantial mixture adjustments and/or the use of a supplemental ignition device, e.g., a spark plug, to maintain or reinitiate the sequential process of the combustion residence chamber 26.

An improved ignition source would offer the ability to fully, reliably, and robustly combust ultra-lean fuel-air mixtures, but without the requirement for the high velocity mixing jet and associated heat transfer as in the combustion residence chamber system. An improved combustion system would furthermore significantly reduce the sensitivity to engine speed and partial misfire associated with the requirement to fully refill the combustion residence chamber prior to the next combustion cycle, and would thereby enable more reliable combustion and higher engine speeds. An improved combustion system would therefore operate more efficiently, more reliably, and at higher engine speeds while achieving low pollution output.

Therefore, there exists a need for a combustion system within a rotary vane engine that is capable of robustly and reliably combusting ultra-lean mixtures across a wider range of engine speeds and conditions than achieved with the combustion residence chamber while simultaneously reducing heat transfer losses.

SUMMARY OF THE INVENTION

In the present invention, a discrete hot wall combustion insert is used in the combustion cycle to robustly and reliably ignite a fuel-air mixture in a combustion cycle.

More specifically, the present invention provides a hot wall combustion insert along the wall of the chamber ring assembly. After engine startup this hot wall combustion insert maintains a temperature sufficient to combust a fuel-air mixture that is provided in a vane cell, and can initiate combustion along the entire azimuthal surface of the hot wall combustion insert.

Accordingly, the present invention is directed to a rotary vane combustion engine that substantially overcomes the limitations and disadvantages of the related art. The hot wall combustion insert offers recovery from misfire and stable, robust combustion of ultra-lean mixtures over a wide range of engine speeds and operating conditions. The hot wall combustion insert represents the first system to use the high stator chamber surface area of the vane engine to advantage rather than disadvantage.

Mixing and combustion of reactants are simultaneously accomplished by also making use of intrinsic characteristics of the rotary vane engine's operation, such the high centrifugal loads on the reactants and the high velocity of the reactants with respect to the stator chamber walls. These characteristics of the rotary vane engine, previously considered inherently negative factors by designers, are transformed into significant, beneficial effects within the present invention.

This novel mating of this hot wall combustion insert with the unique operational characteristics of the rotary vane engine thereby results in synergistic improvements in the engine—yielding improved efficiency and power density, reduced pollution, and simplified design and construction of the engine.

In an effort to achieve the desired goals of this invention, a rotary vane combustion engine is provided. This rotary vane combustion engine includes a rotor having a plurality of vanes; a stator enclosing the rotor to form a plurality of vane cells between the plurality of vanes; one or more intake ports for providing intake gas to the vane cells; a fuel source for mixing fuel with the intake gas to form a fuel-air charge having a fuel-to-air equivalence ratio; a hot wall combustion insert with an exposed surface provided on the stator for igniting the fuel-air charge during a combustion cycle and producing an exhaust gas; and one or more exhaust ports for removing the exhaust gas from the vane cells.

During normal operation the hot wall combustion insert surface is maintained at an ignition temperature sufficient to ignite or initiate combustion of the fuel-air charge.

The fuel-to-air equivalence ratio of the fuel-air charge is preferably less than about 0.65, and the combustion insert surface temperature is about 600° C. or greater.

However, the hot wall combustion insert may be coated with a combustion catalyst to allow combustion of the fuel-air charge to be performed at a lower temperature than would be possible without the combustion catalyst. This combustion catalyst may comprise, by way of example and not limitation, one of gamma alumina and platinum. In this case, the lower ignition limit of the combustion insert surface temperature may drop to between 200° C. and 400° C.

The hot wall combustion insert may be externally heated to the appropriate surface temperature to sustain combustion, or the rotary vane combustion engine may further include a combustion initiator for starting combustion during a startup operation of the rotary vane combustion engine. In this latter case, heat from the combustion process raises the temperature of the hot wall combustion insert, and the combustion initiator operates until the combustion insert is heated to the operating temperature. The combustion initiator may be one of a spark plug and a glow plug or any ignition system known in the art. This initial combustion may be performed at a much richer fuel-air mixture to enable complete combustion with cool walls and a comparatively weak ignition method. After the combustion initiator starts combustion, heat from combustion in successive vane cells maintains the hot wall combustion insert surface at or above an appropriate operating temperature.

The hot wall combustion insert preferably comprises a material having near zero thermal expansion, such as certain ceramic materials. This material may be chosen from the class known as sodium zirconium phosphates. Examples of this class include, without limitation, calcium magnesium zirconium phosphate and barium zirconium phosphate, barium zirconium phospho-silicate, sodium zirconium phosphate, and other alkaline or alkaline earth zirconium phosphate compositions with or without ionic substitutions.

The hot wall combustion insert preferably comprises a curved surface that forms part of an interior sealing wall of the stator, and faces each vane cell during the combustion cycle. The combustion cycle is preferably performed when the vane cells are at or near peak compression.

The hot wall combustion insert is preferably positioned on an inside wall of the stator from about 5 degrees before top dead center to about 25 degrees after top dead center, though these parameters may vary depending on configuration and application.

The rotary vane combustion engine may include at least one cooling plate to provide a liquid cooling channel for the rotary vane combustion engine. The rotary vane combustion engine may also include a rotary scavenging mechanism for performing positive-displacement scavenging of the exhaust and/or intake gases.

BRIEF DESCRIPTION OF THE DRAWINGS

The foregoing and other objects, aspects, and advantages will be described with reference to the drawings, certain dimensions of which have been exaggerated and distorted to better illustrate the features of the invention, and wherein like reference numerals designate like and corresponding parts of the various drawings, and in which.

DETAILED DESCRIPTION OF THE INVENTION

Reference will now be made in detail to an embodiment of a rotary vane combustion engine incorporating a hot wall combustion insert, an example of which is illustrated in the accompanying drawings. The embodiment described below, however, may be incorporated in all rotary vane combustion engines.

Although the disclosed embodiment relates to a rotary vane combustion engine, it should be understood that the teachings of this invention may be applied to any sort of rotary vane pumping machine, including other types of engines, compressors, pumps, generators, or any other kind of displacement device.

U.S. Pat. Nos. 5,524,586, 5,524,587, 5,727,517, 5,836,282, 5,979,395, and 6,036,462, all to Mallen, U.S. patent application Ser. No. 09/185,706, to Mallen, filed Nov. 11, 1998, entitled "Cooling System for a Rotary Vane Pumping Machine," U.S. patent application Ser. No. 09/185,707, to Mallen, filed Nov. 11, 1998, entitled "Vane Slot Roller Assembly for Rotary Vane Pumping Machine and Method for Installing Same," U.S. patent application Ser. No. 09/258,791, to Mallen, filed Mar. 1, 1999, entitled "Vane Pumping Machine Utilizing Invar-Class Alloys for Maximizing Operating Performance and Reducing Pollution Emissions," U.S. patent application Ser. No. 09/302,512, to Mallen, filed Apr. 30, 1999, entitled "Rotary Positive-Displacement Scavenging Device for a Rotary Vane Pumping Machine," U.S. patent application Ser. No. 09/185,705, to Mallen, filed Nov. 4, 1998, entitled "Rotary-Linear Vane Guidance in a Rotary Vane Pumping Machine," and U.S. patent application Ser. No. 09/631,691, to Mallen, filed Aug. 2, 2000, entitled "Variable Bandwidth Striated Charge for Use in a Rotary Vane Pumping Machine" are hereby incorporated by reference in their entirety. For ease of discussion, certain portions of these patents and applications will be reiterated below where appropriate.

Figure 1:
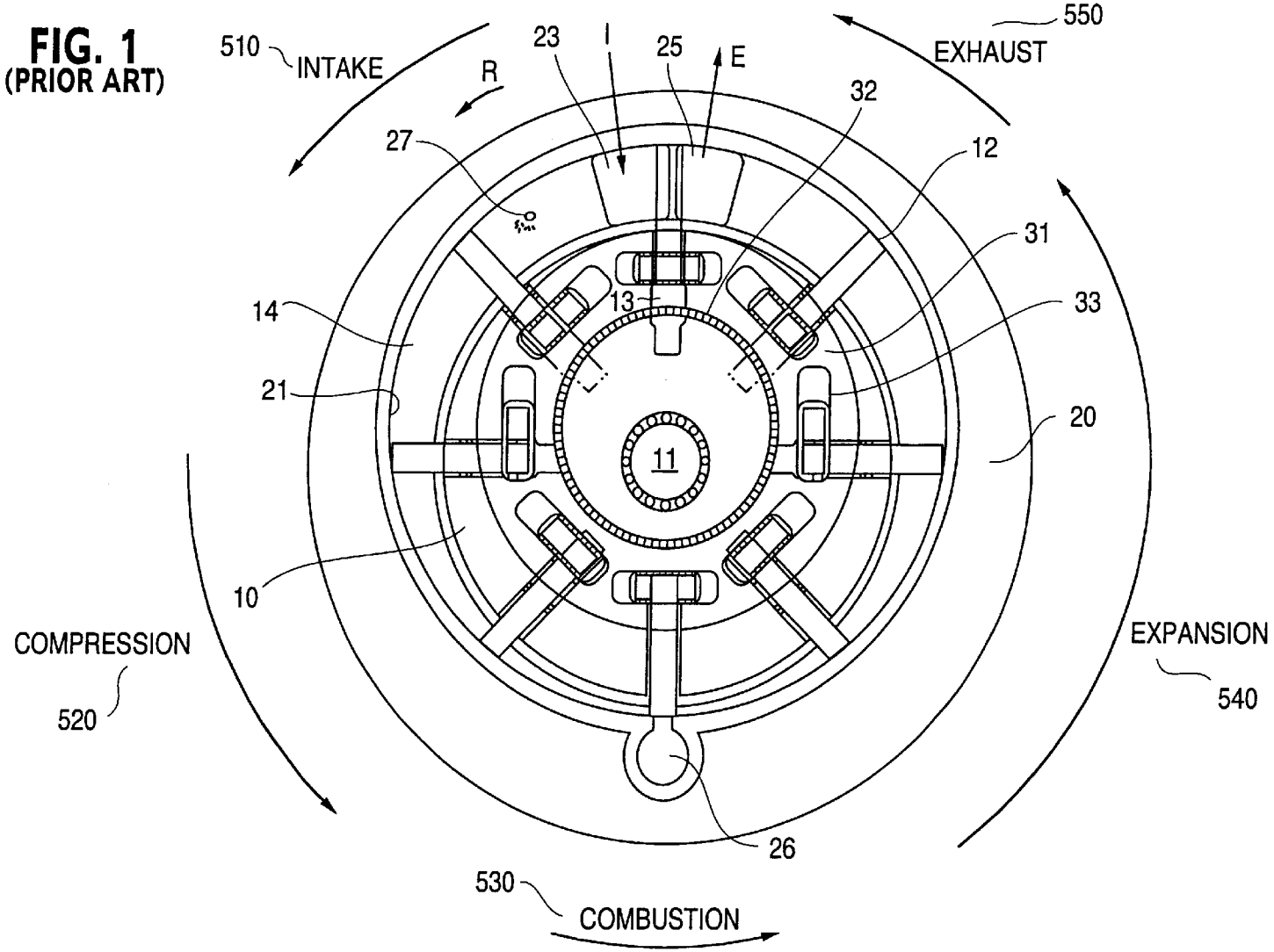
FIG. 1 (PRIOR ART)
FIG. 1 is a side cross sectional view of a conventional rotary vane combustion engine.
Figure 2:
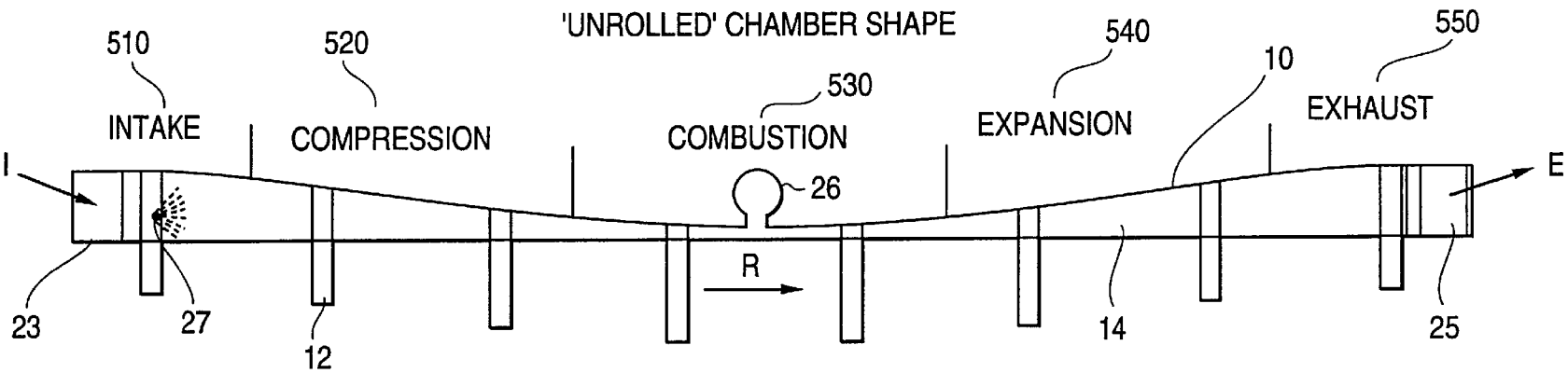
FIG. 2 (PRIOR ART)
FIG. 2 is an unrolled view of the cross-sectional view of FIG. 1.
Figure 3:
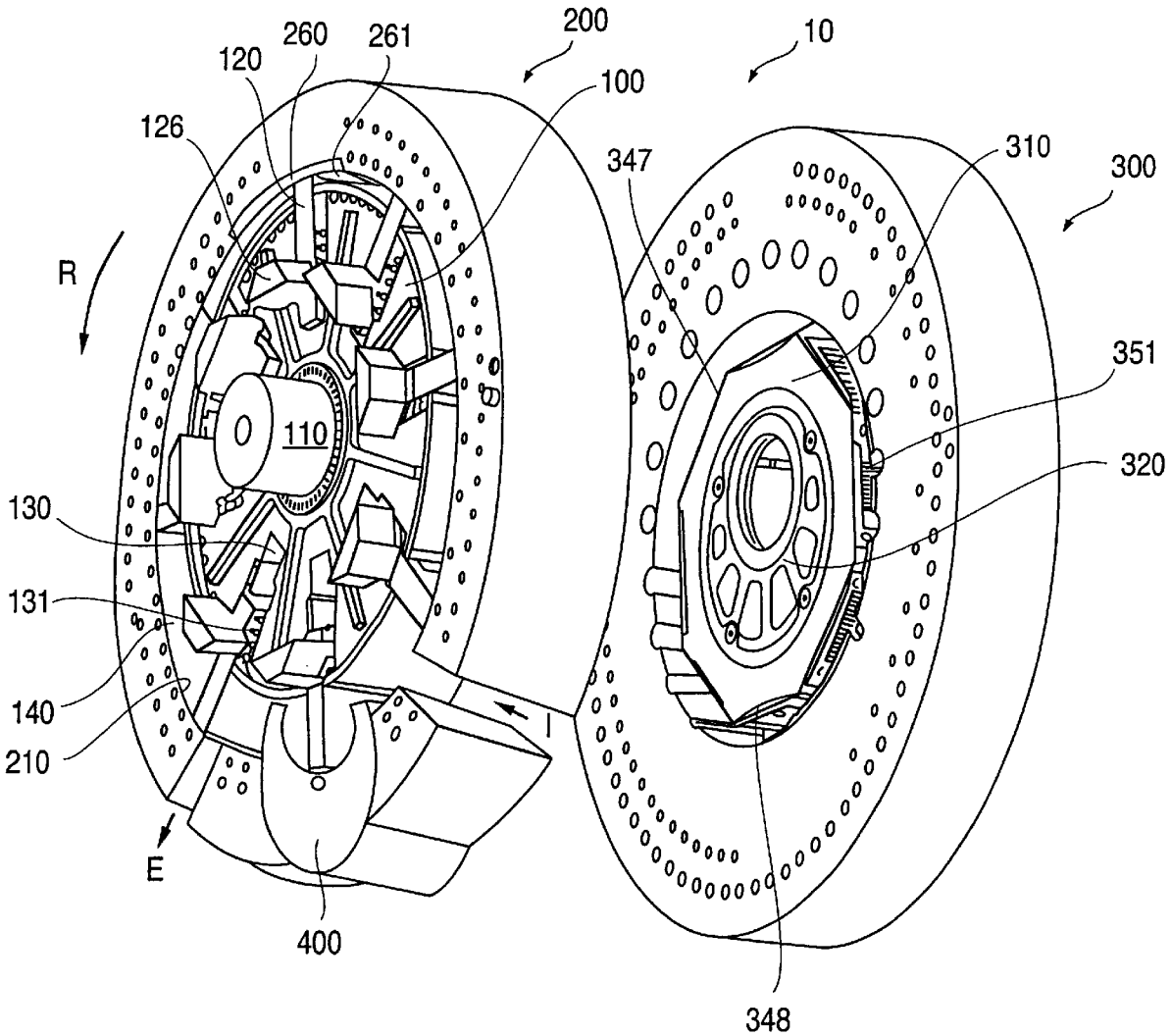
FIG. 3 is an exploded view of a rotary-vane combustion engine according to a preferred embodiment of the present invention, including a hot wall combustion insert.
Figure 4:
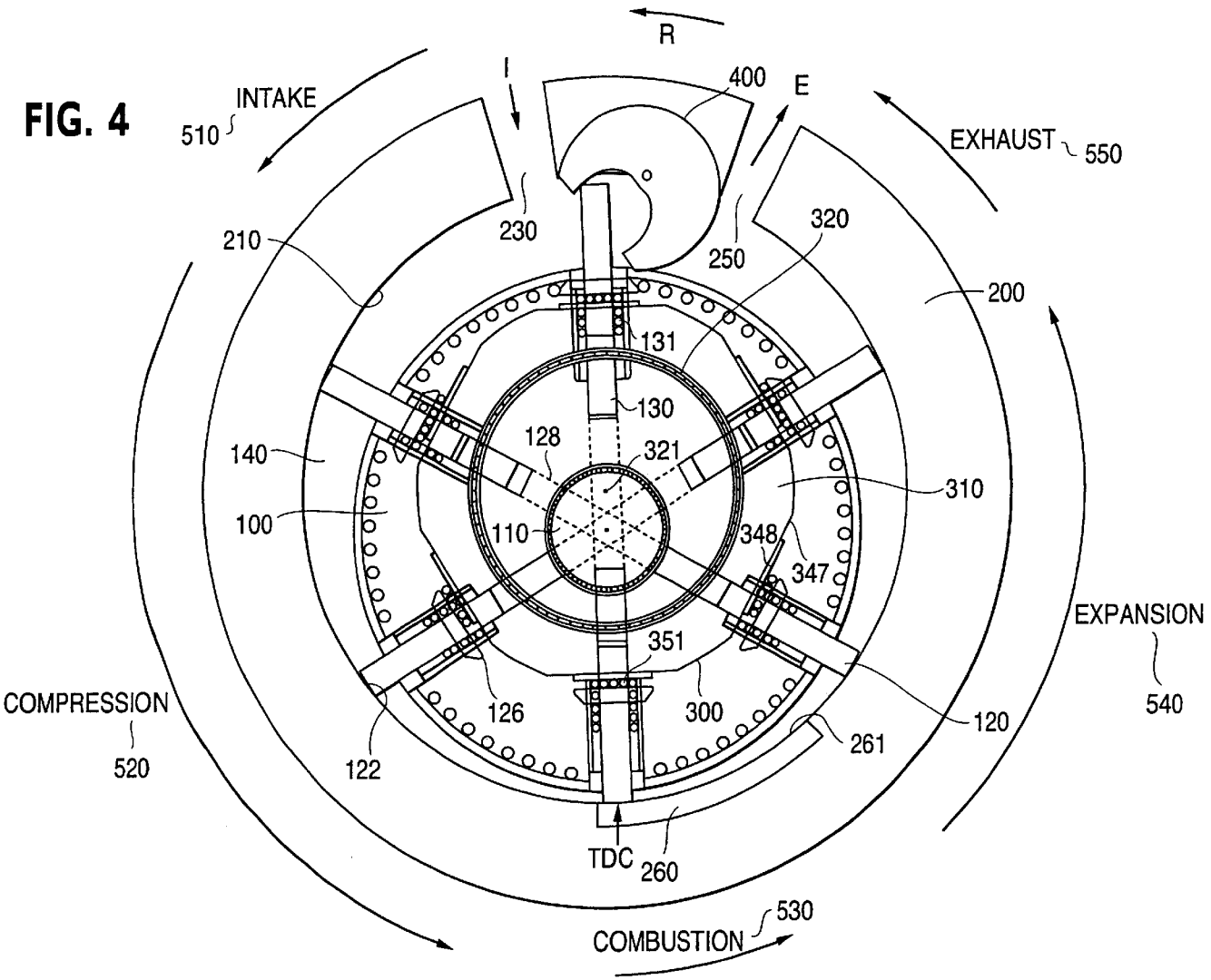
FIG. 4 is a cross section of the rotary vane combustion engine of FIG. 3.
Figure 5:
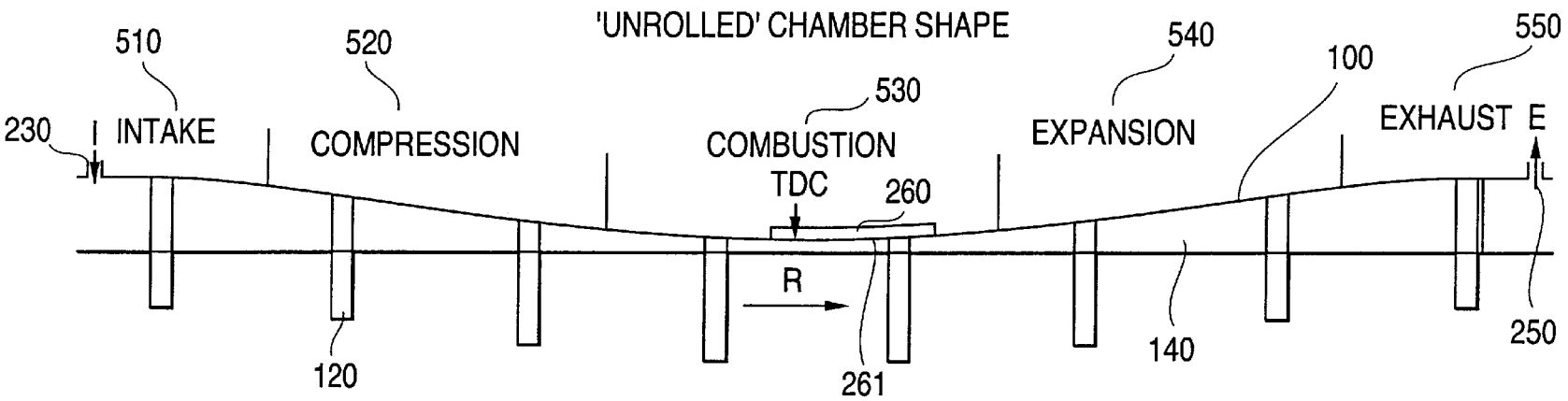
FIG. 5 is an unrolled view of the cross-sectional view of FIG. 4.

An exemplary embodiment of the rotary engine assembly incorporating a rotary-linear vane guidance mechanism and a rotary scavenging device is shown in FIGS. 3 through 5 and is designated generally as reference numeral 10.

The engine assembly contains a rotor 100, a chamber ring assembly 200, and right and left linear translation ring assembly plates 300 (only one is shown for clarity). The rotor 100 includes a rotor shaft 110 and a plurality of vanes 120 in vane slots 130, and each pair of adjacent vanes 120 defines a vane cell 140. Individual vanes 120 each preferably include a vane tip 122 and a protruding vane tab 126 on at least one side of the vane 120. Pairs of opposing vanes 120 are preferably connected through the rotor 100, but may be separate. In the preferred embodiment opposing vane pairs are connected by vane ties 128 that pass through the rotor 100.

The chamber ring assembly 200 includes a stator cavity 210 that forms the roughly circular shape of the chamber outer surface.

At least one of the linear translation ring assembly plates 300 includes a linear translation ring 310. In the preferred embodiment, both linear translation ring assembly plates 300 have a linear translation ring 310. But in alternate embodiments, a single linear translation ring may be used.

The linear translation ring 310 itself spins freely around a fixed hub 320 located in the linear translation ring assembly plate 300, with the axis of the fixed hub 320 being eccentric to the axis of rotor shaft 110. The linear translation ring 310 also contains a plurality of linear channels or facets 330. The linear channels 330 allow the vanes to move linearly as the linear translation ring 310 rotates around the fixed hub 320. Radially-opposing vane pairs may be connected or form monolithic vane pairs which would require only outward facets 330 to guide each opposing vane pair.

The rotor 100 and rotor shaft 110 rotate about a rotor shaft axis in a counter clockwise direction as shown by arrow R in FIG. 3. It can be appreciated that when implemented, the engine assembly could be adapted to allow the rotor 100 to rotate in a clockwise direction if desired. The rotor 100 has a rotational axis, at the axis of the rotor shaft 110, that is fixed relative to the stator cavity 210 contained in the chamber ring assembly 200.

In such a rotary vane engine as illustrated, momentum is transferred from the expanding gases working on the vanes 120 in the expanding vane cell 140, to the rotor 100 through the load bearing function of the rollers in the assembly 131. In an analog rotary pump and during the exhaust or pre-combustion compression cycles, momentum is transferred from the rotor to the gases in a compressing vane cell 140 through the load bearing function of the rollers in the assembly 131. The vanes 120 are radially reciprocating relative to the rotor slots 130, and the friction of sliding between the radially reciprocating vanes and the rotor is substantially reduced by the rolling function of the rollers in the assembly 131. The present invention may use the novel vane slot roller assembly disclosed in U.S. patent Application Ser. No. 09/185,707, to Mallen, filed Nov. 4, 1998, entitled "Vane Slot Roller Assembly for Rotary Vane Pumping Machine, and Method for Installing Same" ('707 application), which is hereby incorporated by reference in its entirety.

As shown in FIG. 3, an end plate 300 is disposed at each axial end of the chamber ring assembly 200 (although only one end plate 300 is shown, it will be understood that there will be one on either end of the chamber ring assembly 200). Within the end plate 300, a linear translation ring 310 spins freely around a fixed hub 320 located in the end plate 300, with the axis 321 of the fixed hub 320 being eccentric to the axis of rotor shaft 110 as best seen in FIG. 4. The linear translation ring 310 may spin around its hub 320 using any type of bearing at the hub-ring interface including for example, a journal bearing of any suitable type and an anti-friction rolling bearing of any suitable type.

The linear translation ring 310 comprises a outer surface 347 having a plurality of connected linear segments 348 or facets. The protruding tabs 126 of the vanes 120 slide along a corresponding linear segment 348 of the outer surface 347, which provides sufficient linear and radial guidance to the vanes 120. A plurality of roller bearings 351 are provided between the lower surface of the vane tab 126 and the linear segment 348, such that the vane tab 126 has a rolling interface with the translation ring 310. The linear segment 348 could be formed as a separate bearing pad or could be integral to the outer surface 347.

In operation, the rotation of the rotor 100 causes rotation of the vanes 120 and a corresponding rotation of each linear translation ring 310. The protruding vane tabs 126 translating along the linear segments 348 of the linear translation rings 310 automatically set the linear translation rings 310 in rotation at a fixed angular velocity identical to the angular velocity of the rotor 100. Therefore, the linear translation ring 310 does not undergo any significant angular acceleration at a given rotor rpm.

Also, the rotation of the rotor 100 in conjunction with the linear translation rings 310 automatically sets the radial position of the vanes 120 at any rotor angle, producing a single contoured path as traced by the vane tips 122 resulting in a unique stator cavity 210 shape that mimics and seals the path the vane tips trace.

No gearing is needed to maintain the proper angular position of the linear translation rings 310 because this function is automatically performed by the geometrical combination of the tabs 126 within the linear segments 348 of the linear translation rings 310, the vanes 120 constrained to radial motion within their rotor slots 130, the rotor 100 about its shaft 110 axis, and the translation ring hub 320 about its offset axis 321 at the center of the fixed hub 320.

FIG. 5 simply shows the operation of FIGS. 3 and 4 in an 'unrolled' state, in which the circular operation of the vane engine assembly is shown in a linear manner. The progression of the cycles 510, 520, 530, 540, and 550 can be seen quite effectively through FIG. 5. FIG. 5 may also be used to represent the application of the present invention in the embodiment of a vane engine in which the vanes reciprocate with an axial component of motion or in the axial direction.

In operation, a fuel-air charge is injected or inducted into the vane cells during the intake cycle 510 to obtain a desired fuel-to-air equivalence ratio. Exemplary fuel injection/induction/mixing devices are shown and described in U.S. Pat. Nos. 5,524,586; 5,524,587; 5,836,282; and 5,979,395 which are all hereby incorporated by reference in their entirety. Fuel injectors of any variety, carburation, or any other means of inducting or supplying fuel into the incoming air charge may be incorporated as well as means to mix or premix the fuel-air charge, and the appropriate system or systems will vary depending upon specific design and application criteria.

In addition, a hot wall combustion insert 260 provides an exposed surface 261 along the circumference of the chamber ring assembly 200. The curved surface 261 of the hot wall combustion insert 260 forms a part of the wall of the chamber ring assembly 200, along a predetermined circumference in the combustion cycle. The hot wall combustion insert 260 preferably communicates with the air or fuel-air charge at about peak compression in the engine assembly. In order to extend the benefits of the hot wall insert it may also be incorporated into the end plates 300.

The hot wall insert may be externally heated. External heating of the hot wall insert would enable it be the sole source of ignition, thereby eliminating the necessity for a secondary ignition device. However, it may be advantageous to forego any external heating of the hot wall insert. After the engine has started the hot wall insert can be the primary source of ignition without external heating, because it retains the heat from the previous combustion cycle acting as a heat sink with no inherent thermal losses.

When the hot wall insert is not externally heated, a secondary source of ignition such as a rapidly-firing or timed spark plug or a glow plug, can be used for engine startup. Once combustion occurs the heat released will rapidly heat the hot wall insert. Once the hot wall insert reaches its operating temperature energy the spark plug or glow plug can be discontinued.

A pair of cooling plates (not shown) may be provided, one each axially adjacent to a respective end plate 300, to encase the engine 10, to provide for cooling channels, and to serve as an attachment point for various devices used to operate the engine 10. Of course, the function of the cooling plates may be incorporated in the end plates 300. In other words, a single plate could provide the features of both the end plate 300 and the cooling plate, or separate plates could be used.

The cooling system for such a rotary vane pumping machine was described in U.S. patent application Ser. No. 09/185,706, to Mallen, filed Nov. 4, 1998, entitled "Cooling System for a Rotary Vane Pumping Machine" (the '706 application), which is hereby incorporated by reference in its entirety. Basically, the '706 application describes a cooling system that can cool either the rotor 100 and associated moving parts, or the stator assembly 200, or both, depending on the operation of the rotary vane pumping machine.

The illustrated embodiment employs a two vane-stroke cycle to maximize the power-to-weight and power-to-size ratios of the machine. In other words, each vane retracts (first stroke) and extends (second stroke) once for each complete combustion or pumping cycle. By comparison, in a four vane-stroke cycle, each vane would retract and extend twice for each complete combustion or pumping cycle. The intake of the fresh air I and the scavenging of the exhaust E are provided via the scavenging device, e.g., a rotary scavenging disk 400, as shown in FIGS. 3 and 4.

The rotary scavenging disk 400 is disposed along the stator circumference, and is sized such that the rotary scavenging disk 400 extends into the vane cell 140. An outer circumferential edge of the rotary scavenging disk 400 is in sealing proximity with an outer circumferential edge of the rotor 100.

Such a rotary scavenging mechanism extends the benefits of positive-displacement scavenging and vacuum throttle capability to a two-stroke vane engine. By employing such a rotary scavenging mechanism the two-stroke vane engine reaps the efficiency and pollution benefits derived from a four-stroke design without incurring any of the associated power density and mechanical friction penalties and other tradeoffs of the four-stroke arrangement. In addition, such a rotary scavenging mechanism provides additional or alternative benefits to certain applications, centering around the derived capability to access the vane cells at targeted positions during the pumping cycle, to purge the cell, exchange gases from/to the cell, and/or induct gases into the cell.

This design in the preferred embodiment offers significant advantages as compared to conventional designs, since combustion is performed along an entire circumferential area, i.e., the area of the hot wall combustion insert 260, rather than at a single point or through the linear opening of a combustion residence chamber. As a result, the combustion must only largely spread radially from the outer edge of the vane cell 140 to the inner edge of the vane cell 140. In comparison, in a conventional point ignition system in a vane engine, the combustion flame must spread both radially and circumferentially to include substantially the entire vane cell before the combustion cycle ends.

The radial distance is much smaller than the axial or azimuthal distances, the radial distance being on the order of ⅛ of an inch compared with the axial or azimuthal distances, which are on the order of 3 to 4 inches, with these dimensions indicating relative proportions for a given engine size rather than requisite or absolute parameters. As a result, the speed of combustion is much faster with a hot wall insert because the insert can extend the whole width of the vane cell, or even further if the end plates 300 have inserts as well.

As a first-order approximation, the different combustion strategies may be described as point, line, and plane ignition devices. The spark plug and glow plug would thus be considered point ignition devices, with the least possible surface area, coverage, and energy. The combustion residence chamber may be thought of as a line ignition device, the line being the charge of hot gases exiting through the linear opening of the combustion residence chamber. The hot wall combustion insert may be described as a planar combustion device. By using this comparative representation, one can see that the surface area and coverage of a plane or wall of ignition is the greatest, followed by the line of ignition, and lastly the point of ignition. This representation is useful in highlighting some of the inherent advantageous of the present invention.

Preferably the hot wall combustion insert 260 is made of a ceramic material that has a near zero thermal expansion, such as a material from the class known as sodium zirconium phosphates (NZP). Examples of this class include, without limitation, calcium magnesium zirconium phosphate, barium zirconium phosphate, barium zirconium phospho-silicate, sodium zirconium phosphate, and other alkaline or alkaline earth zirconium phosphate compositions with or without ionic substitutions, and others all of which have low thermal conductivity, a low thermal expansion coefficient, strong compression parameters, and a low modulus of elasticity.

While the previously described benefits to combustion are an important aspect of the hot wall combustion insert, its other advantages over its absence are manifold and synergistic.

Rotary vane engines generally have a relatively high chamber wall surface area to cell volume ratio during the combustion phase. This high surface-to-volume ratio can adversely affect the vane engine's performance in two ways. One negative effect is heat transfer. Because excessive heating of a metal chamber wall can damage the metal the wall must be kept within certain temperature limits. Often it is necessary to employ a parasitic cooling system to maintain the parameters required by the metal components of an engine. Excessive heat transfer to the cooling system lowers overall efficiency. The hot wall combustion insert functions as an insulator. Ceramics may be employed for lower heat conduction and higher operating temperatures. The hot wall combustion insert mitigates these efficiency losses to the cooling system by insulating the cooling system from the combustion process.

Another benefit of the present invention involves the phenomenon of flame quenching. Flame quenching occurs when combusting reactants come in contact with a surface cool enough to significantly slow or stop the chemical reactions of the combustion process. The cool walls of a conventional combustion chamber produce significant flame quenching. Incomplete combustion means less energy is being extracted from the fuel translating into reduced efficiency. Undesirable pollution emissions are also the product of incomplete combustion. By sharp contrast in a vane engine employing the present invention heat transfer to the hot stator wall during combustion actually aids in the combustion process. The hot wall combustion insert acts as a heat sink, storing thermal energy to ignite and combust fuel-air charges of the vane cells.

Figure 6:
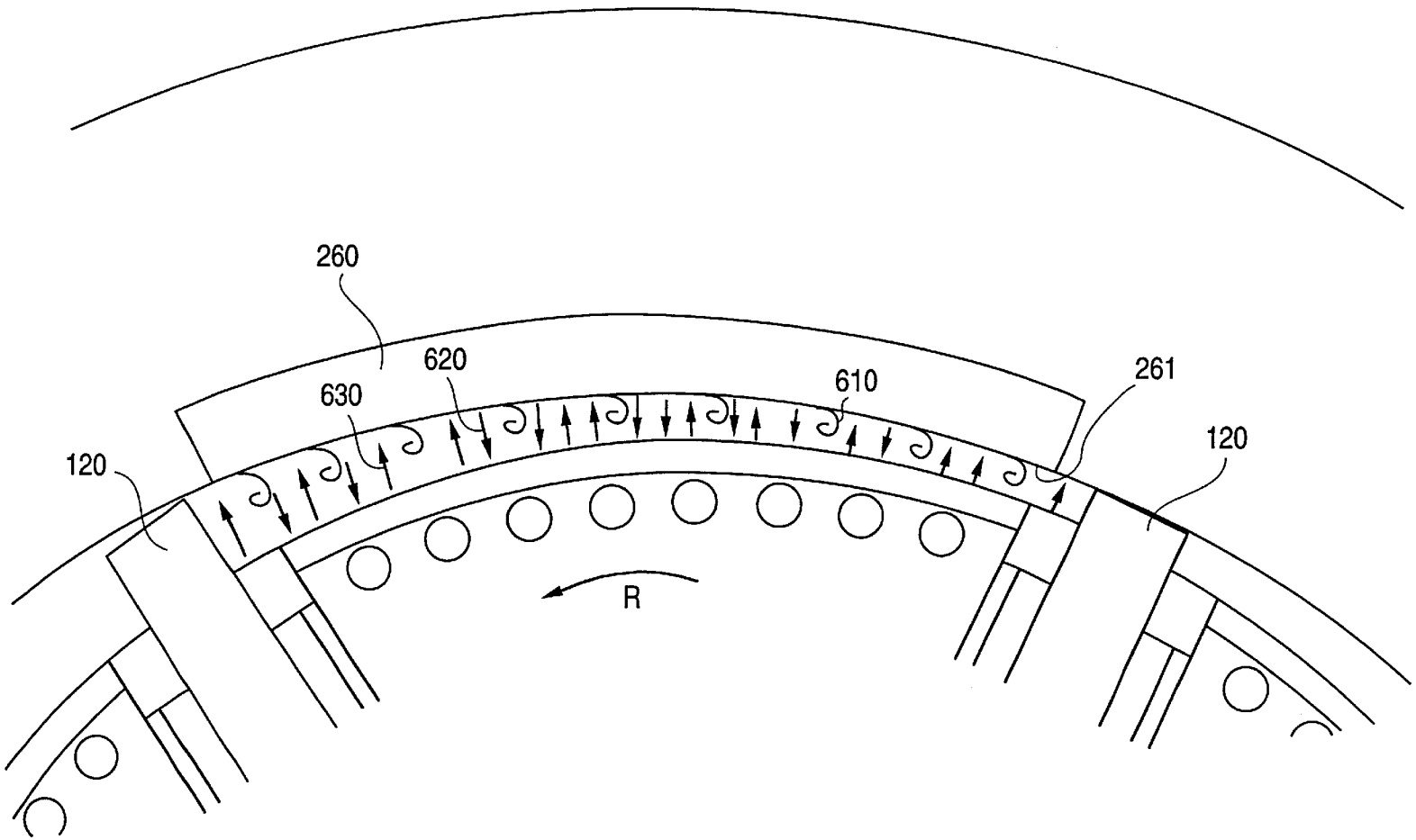
FIG. 6 is a partial cross section of the rotary vane combustion engine of FIG. 3, showing the movement of the air-fuel mixture within a given vane cell.

Still further surprising benefits derive from the present invention. The use of a hot wall combustion insert 260 exploits some of the unique physical phenomenon of air movement in the rotary vane engine to improve combustion, as shown in FIG. 6. For example, as the vanes 120 rotate, and the air-fuel mixture in the vane cells 140 is pushed through the engine, the air-fuel mixture experiences shear 610 as it moves along the non-rotating chamber ring assembly 200. This shear 610 helps mix the combusted air-fuel mixture with the non-combusted air-fuel mixture in the vane cell 140. Shear is the turbulence that occurs as the vane sweeps the charge past the stator and hot wall insert surface. This turbulence causes mixing and more thorough combustion, resulting in increased efficiency and reduced pollution emissions.

The present invention exploits another characteristic resulting from the motion and geometry of the vane engine. The air-fuel mixture in each vane cell 140 experiences centripetal force as it rotates around the rotor shaft 110 axis. However, since cold air is more dense than hot air, the non-combusted (and therefore cooler) air-fuel mixture is pushed out 620 towards the outer wall of the vane cell, i.e., the stator cavity 210 inside wall. This flow of colder air 620 pushes combusted (and therefore hotter and less dense) air-fuel 630 inward towards the rotor 100 and away from the stator cavity 210 inside wall. The exploitation of this flow and mixing pattern, unique to the vane engine geometry, by the hot wall combustion insert yields improvements in combustion efficiency and rate, thereby further improving fuel efficiency and reducing exhaust pollution.

The combination of the many benefits of the hot wall insert allows an ultra-lean mixture to be used over a wider speed range. The high wall temperature of the insert reduces thermal losses to the cooling system, reduces flame quenching and improves combustion efficiency. The improved mixing from boundary layer shear and centripetal forces allows the hot wall to contact a much greater portion of the uncombusted gases than would occur without these effects, thereby amplifying the effectiveness and benefits of the present invention. The benefits of the present invention thus cooperate synergistically to significantly improve the efficiency, pollution output, and performance of the vane engine.

Placement and length of the insert may vary with the application, but typically it will cover the inside wall of the stator cavity 210 from about 5 degrees before top dead center to about 25 degrees after top dead center. Top dead center, as used herein, refers to the point on the stator contact which would be situated in the center of a vane cell at minimum volume. In FIG. 4, the top dead center location on the stator contour would be located at the center of the vane tip and is indicated by the indicator TDC. The starting point effects combustion timing and thus largely depends upon individual engine size, speed, and application. It should also be noted that some of the advantages of the hot wall insert would be realized if the duration or span of the hot wall insert were significantly more narrow. About five degrees before top dead center, as used herein, refers to a general location in the 360 degree cycle which may be from about 25 degrees before top dead center to about 20 degrees after top dead center.

The insert may extend all the way to the exhaust port as well. Such an arrangement further facilitates complete combustion and reduces flame quenching, though certain practical issues must be addressed. For instance, the vanes and rotor will be heated more from radiation and other heat transfer modes via the large expanse of the hot wall in this case. Also the cost of the insert would increase and issues of mechanical integrity and fracture toughness would become more paramount. Given these characteristics of the hot wall insert a duration or span of approximately 30 degrees will yield a desirable starting point for a given design.

During operation, the surface 261 of the hot wall combustion insert 260 is heated to a temperature hot enough to ignite the chosen fuel-to-air ratio used in the rotary vane engine. For a fuel-to-air equivalence ratio of less than about 0.65, a surface temperature of at least roughly 600° C. is preferred. A lower or higher temperature may be used if a higher or lower fuel-to-air ratio is used. The choice of fuel may also raise or lower the minimum surface temperature required to sustain ignition.

The required temperature may be reduced by providing a combustion catalyst in the combustion chamber. One way to provide this would be to coat the hot wall combustion insert with a catalyst such as gamma alumina or platinum. In this case, the lower operating temperature limit of the combustion insert surface could be reduced to 200° C. to 400° C., depending upon the catalyst used. The engine would be easier to start because combustion would not require as high a temperature of the hot wall insert to be attained. Such a catalyst would also enable an even leaner mixture to be combusted.

Preferably, the heat of combustion operates to raise the hot wall combustion insert 260 to its proper temperature, and to maintain it at the proper temperature. As a result, the energy required to maintain the surface temperature for the hot wall combustion insert is minimized, and the need for any external heating mechanism is avoided.

However, this requires special efforts to start combustion and raise the hot wall combustion insert 260 to its operating temperature. In the preferred embodiment, the starting fuel-to-air ratio is closer to stochiometric, and a spark plug or glow plug is used to start combustion. After a few seconds or similar short time of operation, the exposed surface of the hot wall combustion insert 260 will heat up to the desired temperature and the fuel mixture can be progressively leaned.

It will be apparent to those skilled in the art that various modifications and variations can be made in the system and method of the present invention without departing from the spirit or scope of the invention. Thus, it is intended that the present invention cover the modifications and variations of this invention provided they come within the scope of the appended claims and their equivalents.

What is claimed is:

1. The rotary vane combustion engine, comprising:

a rotor having a plurality of vanes;

a stator enclosing the rotor to form a plurality of vane cells between the plurality of vanes;

one or more intake ports for providing intake gas to the vane cells;

a fuel source for mixing fuel with the intake gas to form a fuel-air charge having a fuel-to-air equivalence ratio;

a hot wall combustion insert with an exposed surface provided on the stator for igniting the fuel-air charge during a combustion cycle and producing an exhaust gas; and one or more exhaust ports for removing the exhaust gas from the vane cells.

2. The rotary vane combustion engine, as recited in claim 1, wherein during normal operation the exposed surface is maintained at an ignition temperature sufficient to ignite the fuel-air charge.

3. The rotary vane combustion engine, as recited in claim 2, wherein the fuel-to-air equivalence ratio of the fuel-air charge is less than about 0.65.

4. The rotary vane combustion engine, as recited in claim 2, wherein the ignition temperature is about 600° C. or greater.

5. The rotary vane combustion engine, as recited in claim 2, wherein the exposed surface is coated with a combustion catalyst to allow ignition of the fuel-air charge to be performed at a lower surface temperature than would be possible without the combustion catalyst.

6. The rotary vane combustion engine, as recited in claim 5, wherein the combustion catalyst comprises one of gamma alumina and platinum.

7. The rotary vane combustion engine, as recited in claim 5, wherein the ignition temperature is between 200° C. and 400° C.

8. The rotary vane combustion engine, as recited in claim 2, wherein the hot wall combustion insert is externally heated to the surface temperature.

9. The rotary vane combustion engine, as recited in claim 2, further comprising a combustion initiator for starting combustion during a startup operation of the rotary vane combustion engine, wherein heat from the fuel-air charge combusting raises the temperature of the hot wall combustion insert, and wherein the combustion initiator operates until the exposed surface is heated to the ignition temperature.

10. The rotary vane combustion engine, as recited in claim 9, wherein the combustion initiator comprises one of a spark plug and a glow plug.

11. The rotary vane combustion engine, as recited in claim 9, wherein after the combustion initiator starts combustion, heat from combustion in successive vane cells maintains the hot wall combustion insert at the combustion surface temperature.

12. The rotary vane combustion engine, as recited in claim 1, wherein the hot wall combustion insert comprises a material having near zero thermal expansion.

13. The rotary vane combustion engine, as recited in claim 12, wherein the hot wall combustion insert comprises a ceramic material.

14. The rotary vane combustion engine, as recited in claim 13, wherein the hot wall combustion insert comprises a material from the class known as sodium zirconium phosphates.

15. The rotary vane combustion engine, as recited in claim 14, wherein the hot wall combustion insert comprises one of calcium magnesium zirconium phosphate, barium zirconium phosphate, barium zirconium phospho-silicate, and sodium zirconium phosphate.

16. The rotary vane combustion engine, as recited in claim 1, wherein the hot wall combustion insert comprises a curved surface that forms part of an interior wall of the stator, and faces each vane cell during the combustion cycle.

17. The rotary vane combustion engine, as recited in claim 1, wherein the combustion cycle is performed when the vane cells are at about peak compression.

18. The rotary vane combustion engine, as recited in claim 1, wherein the hot wall combustion insert is positioned on an inside wall of the stator from about 5 degrees before top dead center.

19. The rotary vane combustion engine, as recited in claim 1, further comprising a rotary scavenging mechanism for performing positive-displacement scavenging of at least one of the exhaust and intake gases.

* * * * *

UNITED STATES PATENT AND TRADEMARK OFFICE

CERTIFICATE OF CORRECTION

PATENT NO. : 6,321,713 B1
DATED : November 27, 2001
INVENTOR(S) : Brian D. Mallen It is certified that error appears in the above-identified patent and that said Letters Patent is hereby corrected as shown below:

Title page,
Item [73] Assignee, should read as follows:
-- [73] Asignee: Mallen Research Limited Partnership --.

Signed and Sealed this

Fourteenth Day of May, 2002

*Attest:*

*Attesting Officer*

JAMES E. ROGAN
*Director of the United States Patent and Trademark Office*